US006095369A

United States Patent [19]

Jenkins et al.

[11] Patent Number: 6,095,369

[45] Date of Patent: Aug. 1, 2000

[54] COIN DISPENSING APPARATUS

[76] Inventors: Stuart M. Jenkins, 105 Aldwick Rd., Bognor Regis, West Sussex PO21 2NY; Ralph E. Huckle, Rosevale, Cot Lane, Chidham, Chichester, West Sussex PO18 8SP, both of United Kingdom; Derek Haynes, 676 Thrush Ct., Marco Isl., Fla. 34145

[21] Appl. No.: 09/084,159

[22] Filed: May 23, 1998

[51] Int. Cl.[7] ..... G07F 11/00

[52] U.S. Cl. ..... 221/77; 221/253

[58] Field of Search ..... 221/225, 227, 221/231, 236, 253, 87, 82, 75, 76, 77, 78, 70, 85, 79, 84

[56] References Cited

U.S. PATENT DOCUMENTS 2,358,563 9/1944 Donaldson ..... 221/85

2,735,579 2/1956 Wynn et al. ..... 221/79

4,469,245 9/1984 Fish et al. ..... 221/225

*Primary Examiner*—Kenneth W. Noland

*Attorney, Agent, or Firm*—John P. McGonagle

[57] ABSTRACT

A coin dispensing apparatus comprised of a plurality of magazines for storing coin rolls, a lifting conveyor having a plurality of hods which are driven by the lifting conveyor and interact with an outlet for each magazine to receive coin rolls therefrom. An optional transporting conveyor is also provided. The transport conveyor has a plurality of hods which are driven by the transport conveyor and which interact with the hods of the lifting conveyor for transfer of coin rolls from the lifting conveyor to the transport conveyor. A dispensing outlet is provided which cooperates with the hods of the lifting conveyor or the transport conveyor to receive coin rolls transported thereto.

12 Claims, 5 Drawing Sheets

COIN DISPENSING APPARATUS

BACKGROUND OF THE INVENTION

This invention relates to a coin dispensing apparatus, and more particularly to an apparatus for the storage and dispensing of wrapped rolls of coins.

Current coin dispensing machines are normally of the hopper storage type which require the coins to be stored in bulk. This creates problems for an operator loading the hopper because of the considerable weight of the coins involved and the physical effort required to load the hopper.

Existing hopper delivery systems require coins or coin rolls to be loaded into the top of the hopper. The coin rolls are then delivered at the bottom of the hopper. This has a disadvantage in that the coin rolls are not delivered at a convenient height to the operator. It is generally impractical to mount the coin dispensing apparatus at a higher level due to the considerable weight of the coins involved and the need to lift the coins up to the higher level when loading the hopper.

An aim of the present invention is to overcome the above described problem and disadvantage with existing hopper delivery systems.

SUMMARY OF THE INVENTION

According to a first aspect of the present invention there is provided a coin dispensing apparatus under microprocessor control comprising a lifting conveyor with a plurality of hods incrementally driven by the lifting conveyor, an optional transporting conveyor having a plurality of hods incrementally driven by the transporting conveyor, the hods of each conveyor combining with each other and at least one magazine the outlet of which interfaces with the hods of the lifting conveyor to transfer rolls of coins stored in the or each magazine to the said hods and thereafter to transfer them to either to the hods of the transporting conveyor for delivery to a dispensing outlet or directly to a dispensing outlet.

Preferably, the conveyors are both driven by a single electric motor. Alternatively, each conveyor may be driven by a separate electric motor.

In a preferred construction the magazine or magazines have an automatically operated chock at their outlet end to release the flow of rolls of coins from the or each magazine, when placed in the apparatus and is automatically closed before the or each magazine is removed from the apparatus. The chock can conveniently be operated from a releasable locking mechanism at the rear of the magazine.

The magazine may include a constant force spring connected with a slidable packing plate at the rear of the magazine to apply pressure to the rolls of coins in the magazine to urge them towards the magazine outlet.

According to a another aspect of the invention there is provided a coin change dispenser housing a coin dispensing apparatus as forth in any of the five preceding paragraphs.

In a preferred construction the coin changer dispenser has a housing divided into two parts, a lower armour plated secure safe for the coin dispensing apparatus and an upper part for housing a computer controlled means for accepting and delivering bank notes and delivering the coin rolls.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 3:
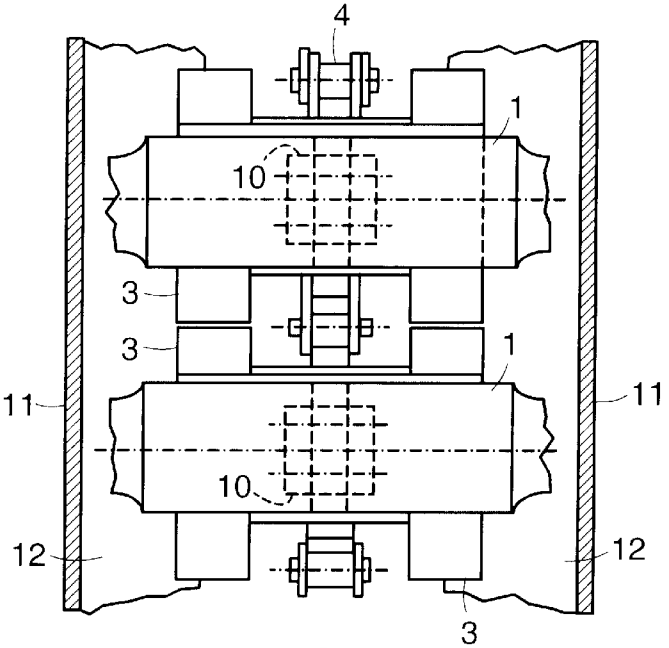
FIG. 3 is an enlarged cross-section taken along the line 3—3 of FIG. 1A.
Figure 4:
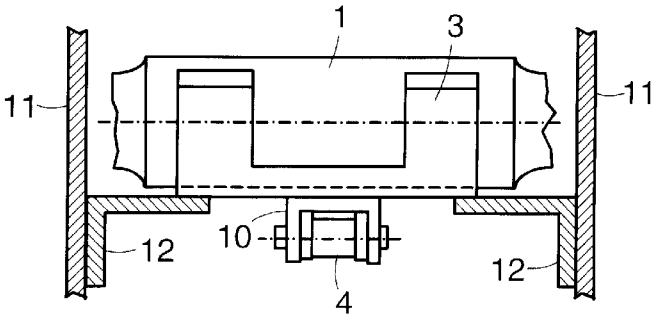
FIG. 4 is an enlarged cross-section taken along the line 4—4 of FIG. 1A.

Referring to the drawings in detail wherein like elements are indicated by like numerals, there is shown a coin dispensing apparatus 100 constructed according to the principles of the invention. The invention 100 is a storage and dispensing apparatus for dispensing wrapped rolls of coins 1 and includes a lifting conveyor generally indicated at 2 with a plurality of hods 3 driven by an endless chain 4 driving two chain wheels 5 and 6. The chain wheel 5 is driven from an electric motor 7 via a chain drive 8. Each lifting conveyor hod 3 is comprised of a U-shaped member 9 the underside of which is linked to the endless chain 4 by brackets 10. See the enlarged detail views in FIGS. 3 and 4. The lifting conveyor hods 3 are guided by side rails 11 and slide on supporting rails 12 which have a low friction coating to accommodate the weight of the coin rolls 1 carried by the lifting conveyor hods 3.

Figures 1A, 2A:
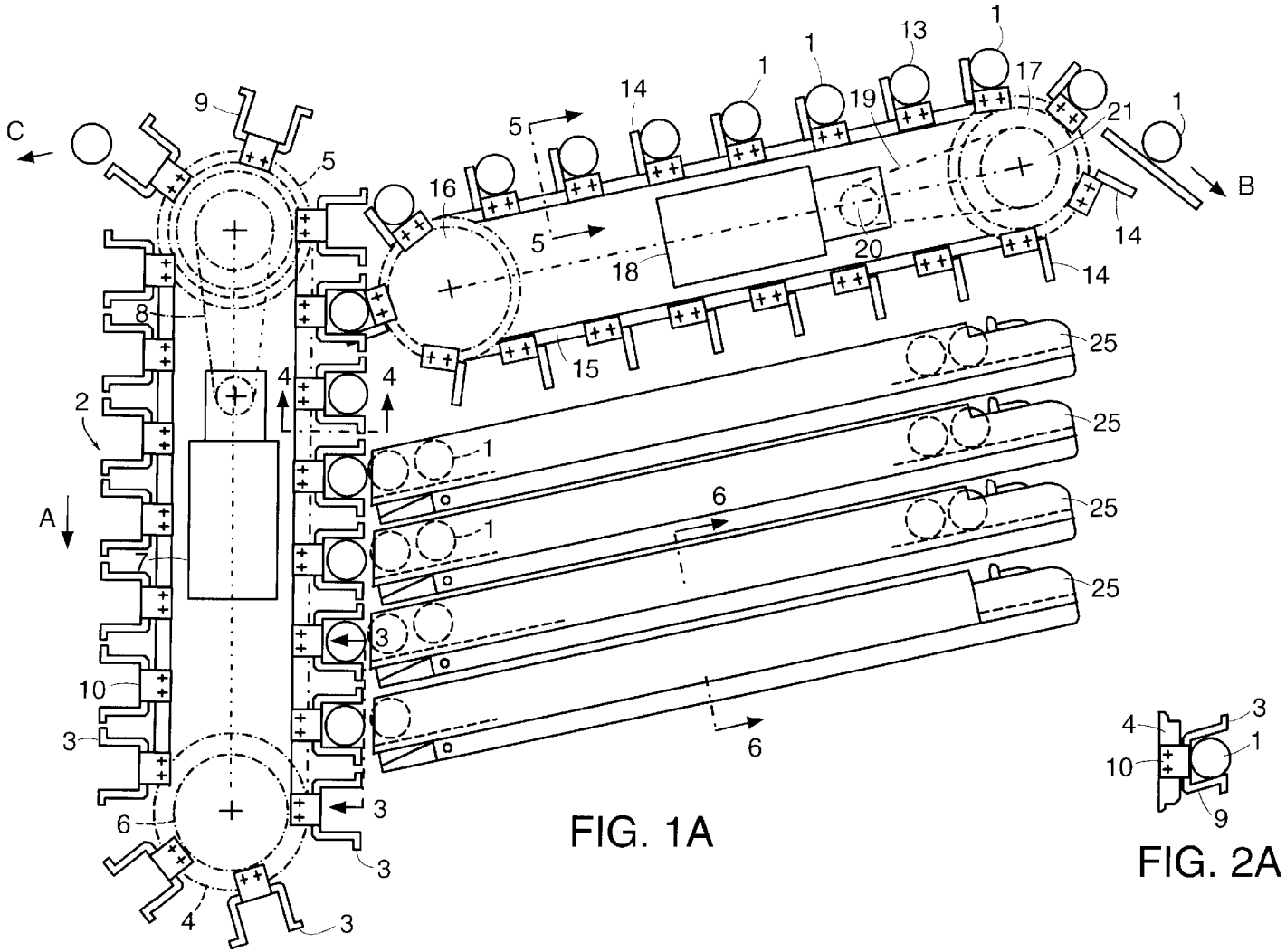
FIG. 1A is a fragmentary side elevation of a co in dispensing apparatus according to the invention and includes a transporting conveyor.
FIG. 2A is a fragmentary cross-section showing a detailed view of a second embodiment of the coin roll transporting hod.
Figure 2B:
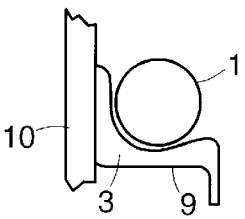
FIG. 2B is a fragmentary cross-section showing a detailed view of a third embodiment of the coin roll transporting hod.

A second embodiment of the lifting conveyor hods 3 is shown in FIG. 2A where the sides 9 of the U-shaped member are located at an angle sloping upwards in the direction of travel arrow "A" of the lifting conveyor 2. A third embodiment of the lifting conveyor hods 3 is shown in FIG. 2B where the hod 3 has a general "L" shape, with a lagging supporting side 9.

Figure 5:
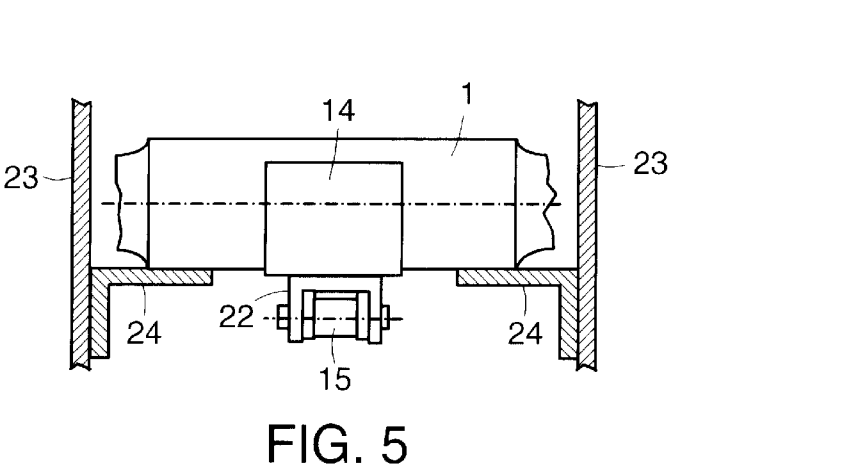
FIG. 5 is an enlarged cross-section taken along the line 5—5 of FIG. 1A.

Located at an angle to the lifting conveyor 2 is an optional transporting conveyor, generally indicated at 13. See FIG. 1A. The transporting conveyor 13 is of similar construction to the lifting conveyor 2 and is comprised of a plurality of hod carriers 14 driven by an endless chain 15 driving chain wheels 16 and 17. As shown in FIG. 1A. the chain wheel 16 is driven by an electric motor 18 via a chain drive 19 encircling chain wheels 20 and 21. The hod carriers 14 are chair-shaped, each hod carrier 14 being connected by a link 22 to the conveyor chain 15. See FIG. 5. The hod carriers 14 are guided by side rails 23 and slide on support rails 24 provided with a low friction coating to accommodate the weight of the coin rolls 1. The electric motors 7 and 18 are connected with sensing devices 7' and 18' which control the drive of the lifting 2 and transporting 13 conveyors, respectively. The sensors 7', 18' sense whether rolls of coins 1 are present within their respective hods 3, 14 and prime the conveyor systems 2, 13 to ensure that the correct dispense is made.

Figure 1B:
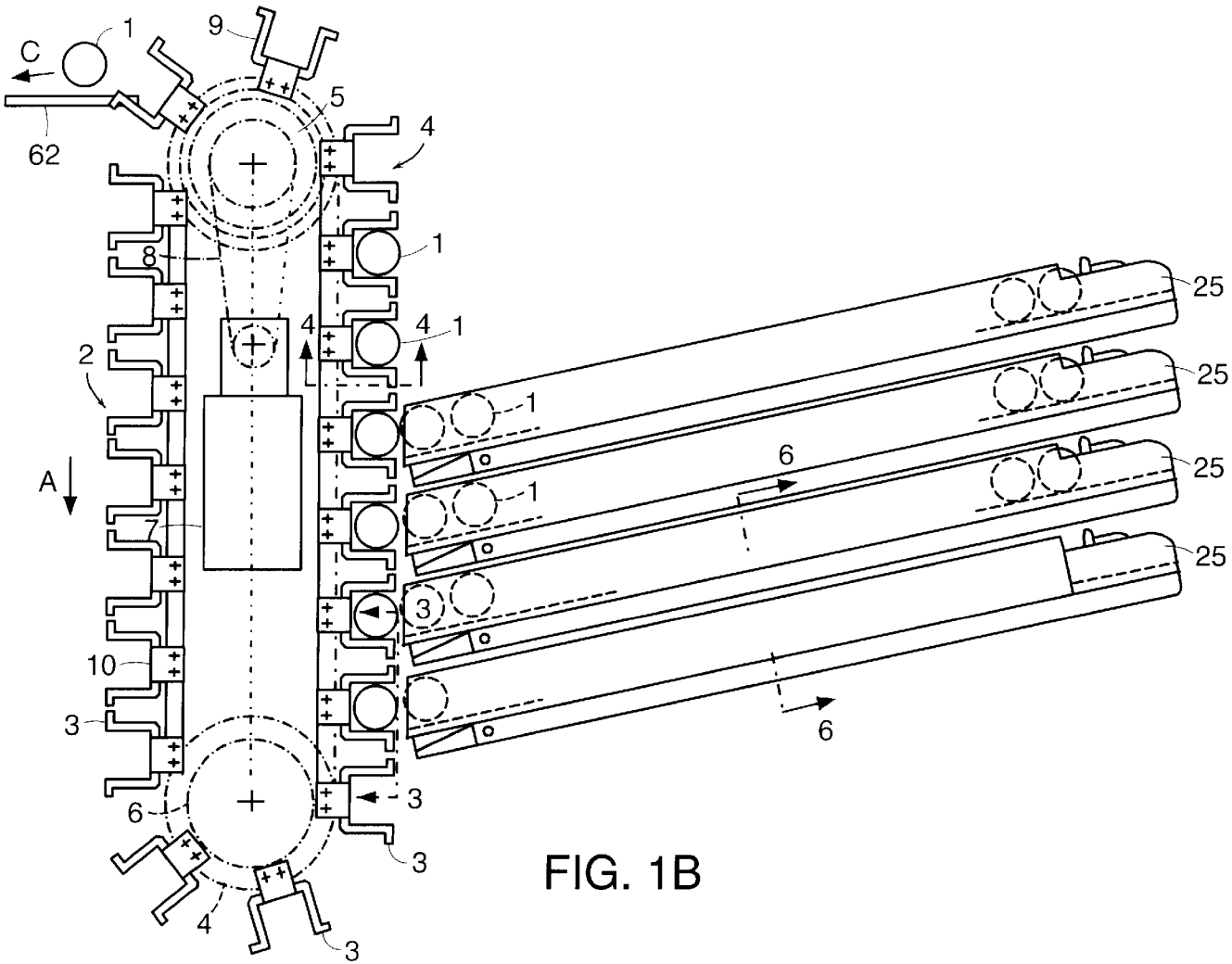
FIG. 1B is a fragmentary side elevation of a coin dispensing apparatus according to the invention constructed without a transporting conveyor.

FIG. 1B illustrates the invention 100 without a transporting conveyor. A separator bridge 62 comparable to "B" in FIG. 1A may be provided when the transporting conveyor is deleted. The coin rolls 1 are carried vertically upward from the magazines 25 described below, over the lifting conveyor 2 top dead center and allowed to feed in to a hopper or slide by gravity over a separator bridge 62 to a chute.

A series of removable magazines 25, four of which are shown, are mounted below the transporting conveyor 13 in FIG. 1A and beside the lifting conveyor 2 in FIGS. 1A and 1B. Each magazine 25 securely carries a supply of coin rolls 1. The magazines 25 slope at an angle downwardly toward the lifting conveyor hods 3. The spacing between magazines 25 correspond to the spacing between hods 3. The magazines 25 may be fabricated from a plastic or metal extrusion or from folded sheet metal joined with adhesive or welded to form the magazine. Each coin roll 1 can be gravity fed or aided using a constant force spring 34.

Figure 6:
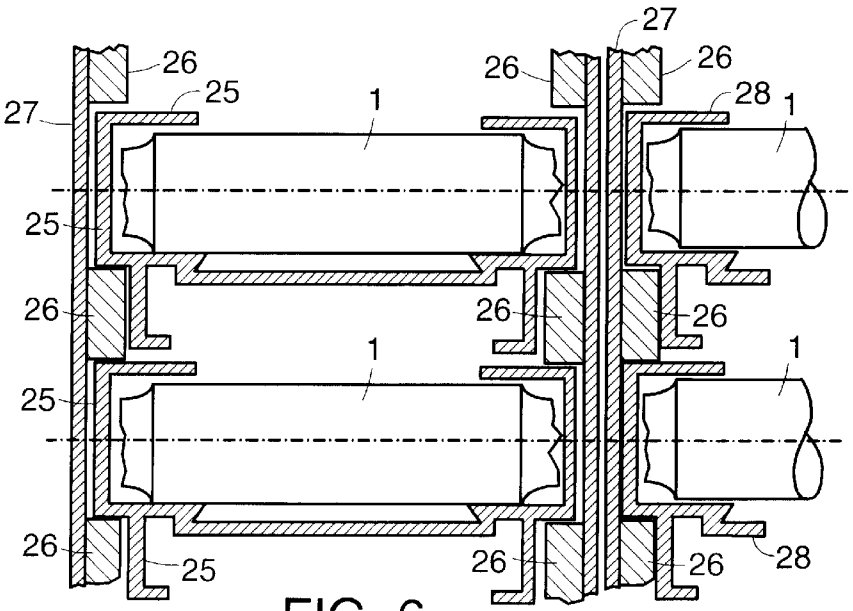
FIG. 6 is an enlarged cross-section taken along the line 6—6 of FIG. 1A.

FIG. 6 illustrate s an enlarged fragment section through two magazines 25 in a tier comprising support blocks 26 and containing side plates 27 for each tier with adjacent magazines 28 for a different coinage, i.e., smaller dimensions.

Figure 11:
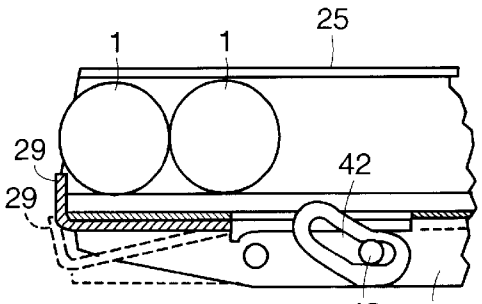
FIG. 11 is an enlarged fragmentary detail of the coin roll chock and its operating mechanism.

The magazines 25 have pivotable chock devices 29 at their leading end or outlet, a detail of which is shown in FIG. 11. The chocks 29 can be automatically opened when inserted in the apparatus 100 and automatically closed before removal from the apparatus 100, thereby maintaining security of the coin rolls 1 in the magazines 25.

Figure 10:
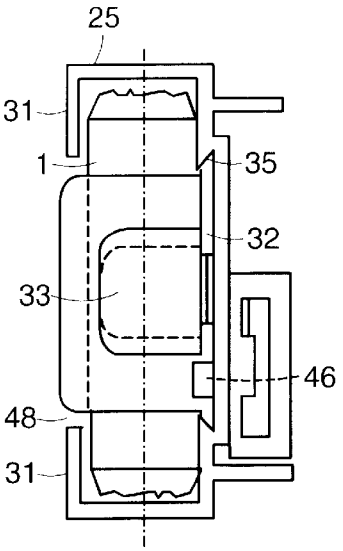
FIG. 10 is an enlarged end view of the magazine shown in FIGS. 7 to 9.

In this embodiment of the invention, each magazine 25 has a main body fabricated from an aluminum alloy extrusion. Each main body could alternatively be manufactured from steel sheet or a plastic extrusion. Each magazine 25 is further comprised of side walls 30 the upper edges of which are bent inwards at 31, and a base plate 32 with a packing plate 33 at its rear end tensioned by a constant force spring 34 to urge the packing plate 33 against the coin rolls 1. The base plate 32 slides in a dovetail 35 while the constant force spring 34 drives the packing plate 33 to apply pressure to the coin rolls 1 ensuring their delivery to the lifting conveyor 2. See FIG. 10. The coin rolls 1 are prevented from falling out of the forward end of the magazine 25 by the chock device 29.

Figure 9:
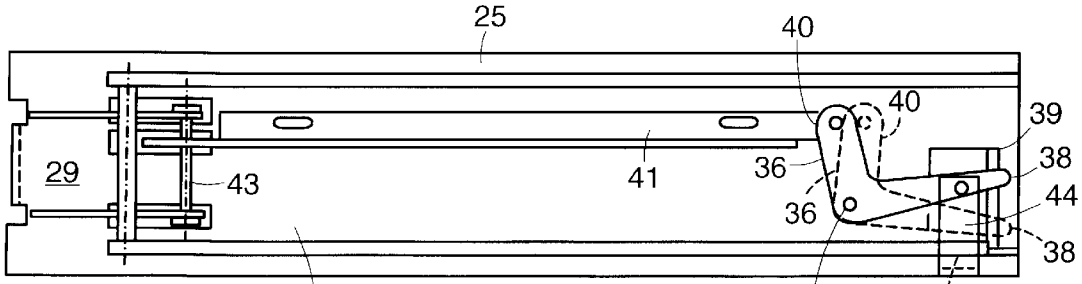
FIG. 9 is an underneath plan view of the magazine shown in FIGS. 7 and 8.

Until it is inserted in the apparatus 100, the chock device 29 is operated by a release mechanism as shown in the underneath plan in FIG. 9 and in side view in FIG. 11. A lever 36 has a spring-loaded pivot 37 which permits one end 38 of lever 36 to move in a gate 39. The other end 40 of lever 36 is connected to the chock device 29 by a link 41 to operate the chock 29 from a closed position to an open position. Movement of the lever 36 pulls on the link 41 the other end of which moves in a cam-track 42 which when moved in the direction of arrow "B" pushes the cross-rod 43 pivoting the chock 29 lowering the end of the chock and allowing the free passage for the next roll of coins 1 to enter an aligned hod 3 of the lifting conveyor 2.

When a fully loaded magazine is placed in the dispenser, the lever 36 cannot be moved to the open position until an interlocking link 44 attached to lever 36 is located opposite and can engage in a slot 45 in the supporting block 26. See FIG. 9.

The magazine cannot be withdrawn until the lever 36 has been moved back with the chock 29 into the closed position. This prevents the inadvertent escape of coin rolls 1 into the dispenser mechanism.

In operation coin rolls 1 are pre-loaded into a magazine 25, each magazine holding, e.g., in the case of USA quarters ($ 0.25), 14 or 16 rolls, each roll containing 40 coins. The weight of each loaded magazine 25 should be less than 5 KG (11 lbs).

The magazines containing the same denomination of coinage are mounted in tiers, 13 or 14 magazines to each tier. The number of magazines is variable to suit the particular application.

The separate tiers of magazines can be placed side by side thus allowing for a variety of coinage to be dispensed, for example, four tiers with quarters, dimes, nickels and pennies. When the magazines are loaded into the dispenser, the coin rolls 1 are then released from the controlling chock in the magazine and the hods 3 of the lifting conveyor 2 are filled. When dispensing, the hods 3 move upwards in steps of one magazine pitch increment. The rolls 1 are transferred to the optional transporting conveyor 13 which also moves in steps of one increment until the delivery to a change dispensing cabinet, as will be hereinafter described, will be complete. The sensor 7' checks the presence or absence of a coin roll 1 in the uppermost hod 3 and the electric motor 7 is allowed to operate the chain wheel 5.

Similarly, the sensor 18' checks that the optional transporting conveyor 13 is fully primed with coin rolls 1 before any dispense is made along a dispensing path as indicated by arrow "B" to the coin change dispenser. An alternative dispensing path is provided at the top left hand side of FIG. 1 as indicated by arrow "C". In this embodiment the coin rolls 1 are carried by the hods 3 over the chain wheel 5 to the dispensing path, arrow "C". Once the hods of the lifting conveyor and those of the optional transporting conveyor are primed, the dispensing cycle is speedily completed.

The essence of the secure and reliable operation of the coin dispensing apparatus is the smooth incremental interface of the magazine outlets with the hods 3 of the lifting conveyor 2. The arrangement of the magazines 25 is such that the lower magazine empties first and then progresses upwards to empty the next magazine immediately above.

Sensors 64 can be placed in appropriate positions in the transport to give indication of the low condition of coin rolls 1 in each magazine 25 to facilitate the replenishment of empty magazines 25. Visual indicators 65 may also be provided by means of visible LEDs and fiber optic links to indicate which magazines are empty. In this embodiment of the invention, the indicators 65 appear on the screen 53 shown in FIG. 12.

The coin rolls 1, although released by the chock 29, will be held back by the bent edges 31 of the hods 3 until an empty hod is aligned with a coin roll 1 which, under pressure of the constant force spring 34, pushes a coin roll 1 into the empty hod. This provides an automatic and secure handling of the coin rolls 1 within the reinforced safe area of the dispenser.

Figure 7:
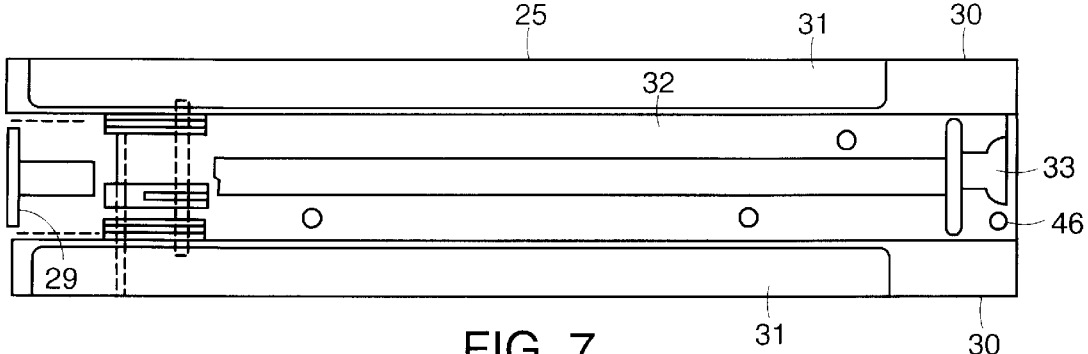
FIG. 7 is a plan view of a wrapped coin roll magazine.

If a magazine 25 is withdrawn before it is completely empty, an interlock mechanism on the chock device 29 prevents the remaining rolls 1 in the magazine from falling out of the magazine into the dispenser. By pulling the packing plate 33 back against the stop 46 (see FIG. 7), a loading gap 47 is formed to enable further coin rolls 1 to be fed into the magazine 25. The open top 48 of the magazine (see FIG. 10) allows complete access to the magazine 25 to permit an ordered and neat loading of the magazine.

Figure 8:
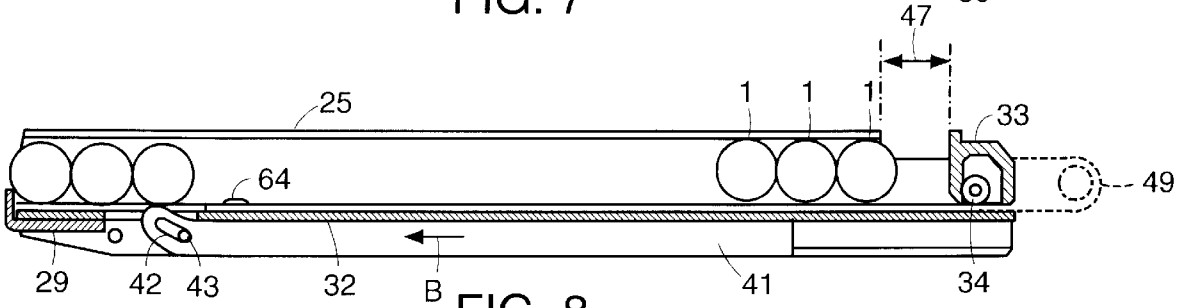
FIG. 8 is a longitudinal cross-section of the magazine shown in FIG. 7.

Each magazine 25 may be provided with a carrying handle 49, one of which is shown in chain dotted line in FIG. 8.

Figure 13:
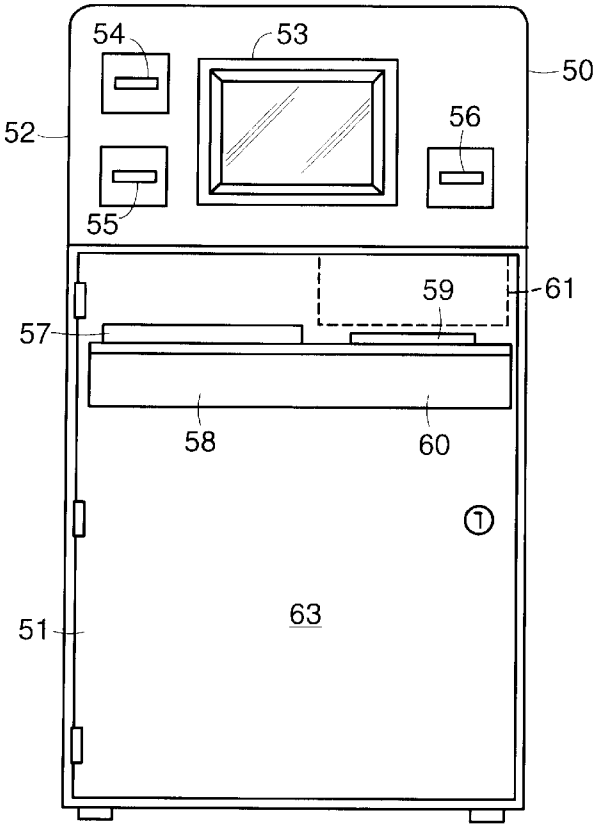
FIG. 13 is a front elevation of the cabinet shown in FIG. 12.
Figure 12:
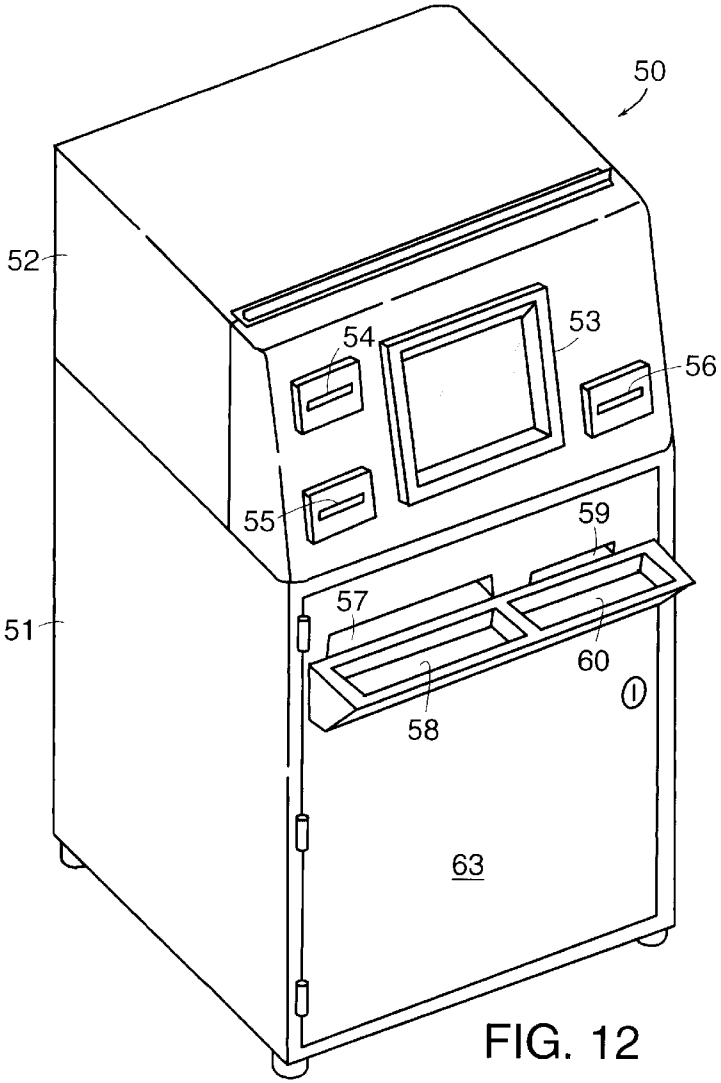
FIG. 12 is a perspective view of a change dispensing cabinet incorporating the coin dispensing apparatus of the present invention.

An embodiment of a change dispensing cabinet for housing the coin dispensing apparatus according to the present invention is shown in FIGS. 12 and 13. The cabinet 50 has two main parts, a lower secure part 51 for housing the coin dispensing apparatus. This portion 51 of the housing is made from armour plate material, as used in bank safes. Although the lower secure part 51 is shown with a door 63 in the front of the unit 50, the door could optionally be configured on the side or rear of the unit 50. The upper part 52 is made from sheet steel or other rigid material and houses computer controlled receipt and delivery mechanisms for receiving bank notes to be changed and delivering bank notes to a customer to compliment the coin changing apparatus.

The upper housing part 52 may include one of the available bank note handling apparatuses with, for example, a touch sensitive video screen 53 to display messages and to receive information concerning the money changing transaction. A PIN-type card reader slot 54, a receipt deliver slot 55 and a bank note acceptor slot 56 are monitored by a conventional microprocessor (not shown). The front of the lower housing part 51 has a coin delivery slot 57 through which the coin rolls 1 are dispensed into a tray 58. Adjacent the coin dispensing slot 57 is a bank note delivery slot 59 below which is a tray 60 into which the dispensed notes fall. Located above the delivery slot 59 is a receptacle 61 for receiving notes fed into the bank acceptor slot 56.

To operate the change dispenser, the customer places his bank card bearing his PIN number into the slot 54 to identify himself. A large denomination bank note for which small change is required is fed into the bank note acceptor slot 56. The screen 53 with the touch sensitive areas is programed with the denomination of change required and the transaction is carried out dispensing the requested number of rolls of coin and, if appropriate, the balance in smaller denomination bank notes from a bank note dispenser located within the lower secure housing part 51. The transaction is recorded on a receipt, if requested, which is then dispensed from slot 55.

As the cabinet is divided into two parts, the lower secure housing 51 and an upper less secure housing 52, servicing of the computer controlled circuit can be carried out without emptying the money from the secure housing 51.

Another advantage of the present invention is that all the heavy coin rolls are stored in magazines at a low level so that the operator can replenish the coin dispensing apparatus without having to lift the magazines loaded with coin rolls to a great height as is the case with hopper fed dispensing apparatus.

The coin rolls 1 may be loaded from the rear or either side. This is accomplished by moving the coin dispenser portion, i.e., magazine tiers and conveyors, contained in the lower secure part out on slides or on a moving suspension system. The dispenser assembly can be built as a right side or left side loading system by changing the slotted plate from left to right, effectively reversing the image of the coin dispenser. Similarly, the height of the coin dispenser is adjustable to allow the unit to be installed in different mainframe sizes.

It is understood that the above-described embodiment is merely illustrative of the application. Other embodiments may be readily devised by those skilled in the art which will embody the principles of the invention and fall within the spirit and scope thereof.

We claim:

1. A coin dispensing apparatus, comprising:

a plurality of magazines arranged one above another for storing rolls of coins, each magazine having a coin roll outlet at one end and an opposite rear end;

a lifting conveyor having a plurality of "L" shaped hods which interact with the outlet of the magazine to receive coin rolls therefrom;

means for supporting the magazines in position with a spacing between them the same as the spacing of the hods along the lifting conveyor;

a dispensing outlet adapted to receive and dispense coin rolls transported thereto by the lifting conveyor; and a plurality of sensors for detection of a coin roll low supply condition.

2. A coin dispensing apparatus as claimed in claim 1, wherein:

each magazine has a constant force spring connected with a slidable packing plate at the magazine rear end to apply pressure to the coin rolls in the magazine thereby urging them towards the magazine outlet.

3. A coin dispensing apparatus as claimed in claim 2, wherein:

each magazine has an automatically operated chock at its outlet end adapted to control a flow of coin rolls from the magazine.

4. A coin dispensing apparatus as claimed in claim 3, wherein:

said chock is operated from a releasable locking mechanism at the magazine rear end.

5. A coin dispensing apparatus as claimed in claim 4, further comprising:

a side guide rail on each side of the lifting conveyor parallel to the conveyor direction of travel;

a support rail having a low friction coating on each side of the lifting conveyor parallel to the conveyor direction of travel;

wherein the lifting conveyor hods run between the side guide rails and are slidably supported on said support rails.

6. A coin dispensing apparatus as claimed in claim 5, further comprising:

a housing enclosing the apparatus, said housing having a lower armour plated secure safe and an upper part.

7. A coin dispensing apparatus as claimed in claim 1, further comprising:

a transporting conveyor having a plurality of "L" shaped hods which interact with the lifting conveyor hods to transport the coin rolls from the lifting conveyor to the dispensing outlet; and a plurality of sensors for detection of a coin roll low supply condition.

8. A coin dispensing apparatus as claimed in claim 7, wherein:

each magazine has a constant force spring connected with a slidable packing plate at the magazine rear end to apply pressure to the coin rolls in the magazine thereby urging them towards the magazine outlet.

9. A coin dispensing apparatus as claimed in claim 8, wherein:

each magazine has an automatically operated chock at its outlet end adapted to control a flow of coin rolls from the magazine.

10. A coin dispensing apparatus as claimed in claim 7, wherein:

said chock is operated from a releasable locking mechanism at the magazine rear end.

11. A coin dispensing apparatus as claimed in claim 10, further comprising:

a side guide rail on each side of the transporting conveyor parallel to the conveyor direction of travel;

a support rail having a low friction coating on each side of the transporting conveyor parallel to the conveyor direction of travel;

wherein the transporting conveyor hods run between the side guide rails and are slidably supported on said support rails.

12. A coin dispensing apparatus as claimed in claim 11, further comprising:

a housing enclosing the apparatus, said housing having a lower armour plated secure safe and an upper part.

* * * * *